US005805181A

United States Patent [19]

Tanaka et al.

[11] Patent Number: 5,805,181

[45] Date of Patent: Sep. 8, 1998

[54] STORAGE CASE FOR STORING AN INK JET PRINTING UNIT, THE INK JET PRINTING UNIT INCLUDING AN INK JET RECORDING HEAD AND CARTRIDGE

[75] Inventors: Yuji Tanaka; Takeo Seino; Kazuhiko Hara; Masahiro Isono; Seiji Mochizuki, all of Nagano, Japan

[73] Assignee: Seiko Epson Corporation, Tokyo, Japan

[21] Appl. No.: 614,159

[22] Filed: Mar. 8, 1996

[30] Foreign Application Priority Data

Mar. 13, 1995 [JP] Japan ..... 7-080819

[51] Int. Cl.[6] ..... B41J 2/165; B41J 29/13

[52] U.S. Cl. ..... 347/29; 347/108

[58] Field of Search ..... 347/7, 20, 29, 347/36, 45, 47, 84, 86, 108, 138, 170, 222, 245, 263

[56] References Cited

U.S. PATENT DOCUMENTS

| | | | |
|---|---|---|---|
| 4,432,004 | 2/1984 | Glattli | 347/28 |
| 4,636,814 | 1/1987 | Terasawa | 347/86 |
| 4,707,714 | 11/1987 | Rosenthal et al. | 347/29 |
| 4,819,012 | 4/1989 | Kiyohara et al. | 347/30 |
| 4,926,196 | 5/1990 | Mizoguchi et al. | 347/23 |
| 5,436,652 | 7/1995 | Mizoguchi et al. | 347/108 |
| 5,587,731 | 12/1996 | Yasunaga et al. | 347/86 |

FOREIGN PATENT DOCUMENTS

| | | | |
|---|---|---|---|
| 0 560 266 | 9/1993 | European Pat. Off. | B41J 2/175 |
| 0560266 | 9/1993 | European Pat. Off. . | |
| 0 598 481 | 5/1994 | European Pat. Off. | B41J 2/175 |
| 0598481 | 5/1994 | European Pat. Off. . | |
| 0605183 | 7/1994 | European Pat. Off. . | |
| 0671273 | 9/1995 | European Pat. Off. | B41J 2/165 |
| 5-270002 | 10/1993 | Japan | B41J 2/175 |
| 7-17048 | 1/1995 | Japan | B41J 3/04 |
| 2264927 | 9/1993 | United Kingdom | B65D 81/26 |

*Primary Examiner*—Adolf Berhane
*Attorney, Agent, or Firm*—Sughrue, Mion, Zinn, Macpeak & Seas, PLLC

[57] ABSTRACT

An ink jet print unit storing case having a case main body 30 with a cap 40 and a cover member 32 with a plate spring 46. The case main body 30 has the cap 40 at a position confronting a recording head 12 when a print unit 6 is accommodated in the case main body 30. The cap 40 not only is such that a peripheral edge thereof 40*a* comes in resilient contact with the recording head 12 so as to form a space with respect to the nozzle openings of the recording head, but also communicates with the atmosphere through a fluid resisting passage so as to prevent the evaporation of ink from the nozzle openings which maintains the meniscus of the recording head in a printing ready state, even in the presence of temperature and pressure fluctuations. The cover member 32 is arranged on the case main body 30 so as to be opened and closed, and has the plate spring 46 that resiliently urges the print unit 6 toward the cap 40.

14 Claims, 8 Drawing Sheets

STORAGE CASE FOR STORING AN INK JET PRINTING UNIT, THE INK JET PRINTING UNIT INCLUDING AN INK JET RECORDING HEAD AND CARTRIDGE

BACKGROUND OF THE INVENTION

1. Field of the Invention

The invention relates to a case for storing an ink jet print unit that integrates an ink jet recording head and an ink cartridge with each other and that is releasably mounted on a carriage.

2. Related Art

An ink jet printer can form monochromatic prints and color prints simply by using inks of different colors because the ink jet printer prints data by forming dots on a recording medium while jetting ink droplets onto the recording medium out of nozzle openings.

Accordingly, ink jet printers having a recording head for monochromatic printing and a recording head for color printing releasably mounted on the carriage have been developed.

If such printer is used, prints can be formed for text data as well as color graphic data with a single printer. However, the recording head that is not operated for printing must be stored with the nozzle opening surface thereof capped in order to prevent the ink(s) from evaporating and, therefore, being unusable.

To meet this requirement, a case has been proposed in, e.g., Unexamined Japanese Patent Publication No. Hei. 5-270002. The case disclosed in this publication is characterized as including: a seal member made of a resilient body for sealing the nozzle openings while coming in contact with the ink jet recording head; a cover member that is opened and closed; and a resilient member that supports the ink jet print unit resiliently while keeping the nozzle openings sealed by the seal member with the cover member closed.

However, since the nozzle openings are sealed by bringing the seal member into direct contact with the nozzle openings, ink overflowing from the nozzle openings due to temperature and pressure fluctuations deposits on the seal member, or the meniscus of each nozzle opening becomes depressed due to the expansion and contraction of air present between the nozzle opening and the seal member.

SUMMARY OF THE INVENTION

The invention has been made in view of the aforementioned problems. The object of the invention is therefore to provide an ink jet print unit storing case that can keep the meniscus of each nozzle opening ready for printing over a long period of time while the ink jet print unit is being stored.

To achieve the above object, the invention is applied to a case for storing an ink jet print unit, the ink jet print unit having a recording head and an ink tank held integrally. The recording head has nozzle openings for jetting ink droplets, and the ink tank supplies an ink to the recording head. The case has a case main body with a cap and a cover member with a resilient member. The cap is such that an upper peripheral edge thereof comes in resilient contact with the recording head so as to form a space with respect to the nozzle openings at a position confronting the recording head when the print unit is accommodated in the case main body. The cap also communicates with the atmosphere through a fluid resisting passage. The cover member is arranged on the case main body such that it can be opened and closed. The resilient member resiliently urges the print unit toward the cap.

The meniscus of each nozzle opening is kept ready for printing independently of temperature and pressure fluctuations by not only preventing the ink from evaporating through the nozzle openings as much as possible while causing the vapor of a solvent in the ink to stagnate in the fluid resisting passage, but also by allowing the vapor of the solvent in the ink to communicate with the atmosphere.

DETAILED DESCRIPTION OF THE PREFERRED EMBODIMENT

Figure 1:
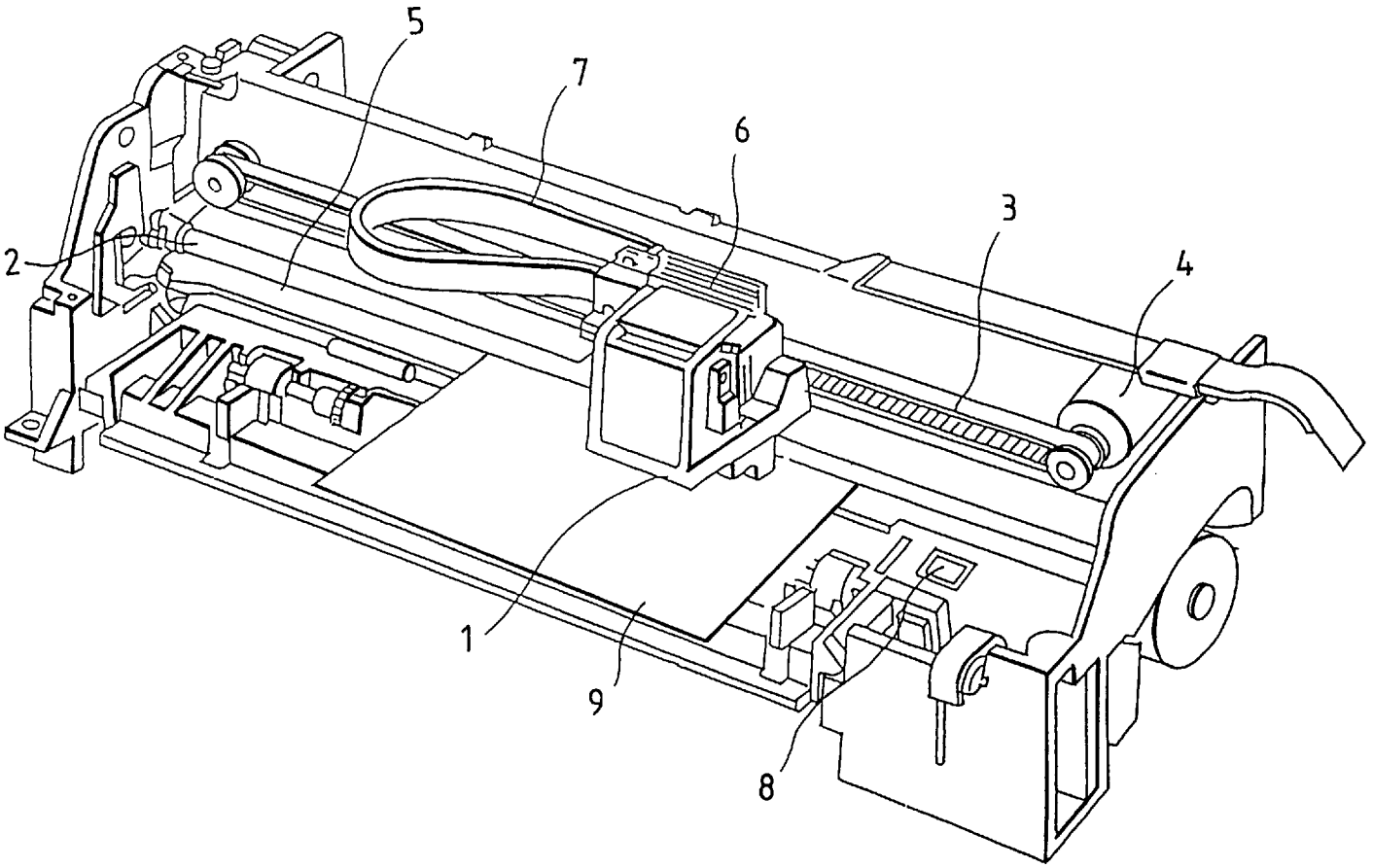
FIG. 1 is a diagram showing an embodiment of an ink jet printer to which interchangeable print units are applied.

Details of the invention will now be described with reference to embodiments thereof shown in the drawings.

FIG. 1 shows an ink jet recording apparatus to which an ink jet print unit of the invention is applied. In FIG. 1, reference numeral 1 denotes a carriage, which is supported by a guide member 2 and connected to a stepping motor 4 through a timing belt 3 so that the carriage 1 can reciprocate in parallel with a platen 5.

An ink jet print unit 6, which will be described later, is releasably mounted on the carriage 1, and is designed to be interchangeable in accordance with the type of printing which is to be performed, monochromatic printing or color printing. The print unit 6 mounted on the carriage 1 receives a drive signal through a flexible cable 7, one end of the flexible cable 7 being connected to a not shown recording head drive circuit and the other end thereof being fixed to the carriage 1.

It may be noted that reference numeral 8 denotes a capping means that seals the recording head while no printing operation is being performed and that reference numeral 9 denotes a recording sheet.

Figure 2:
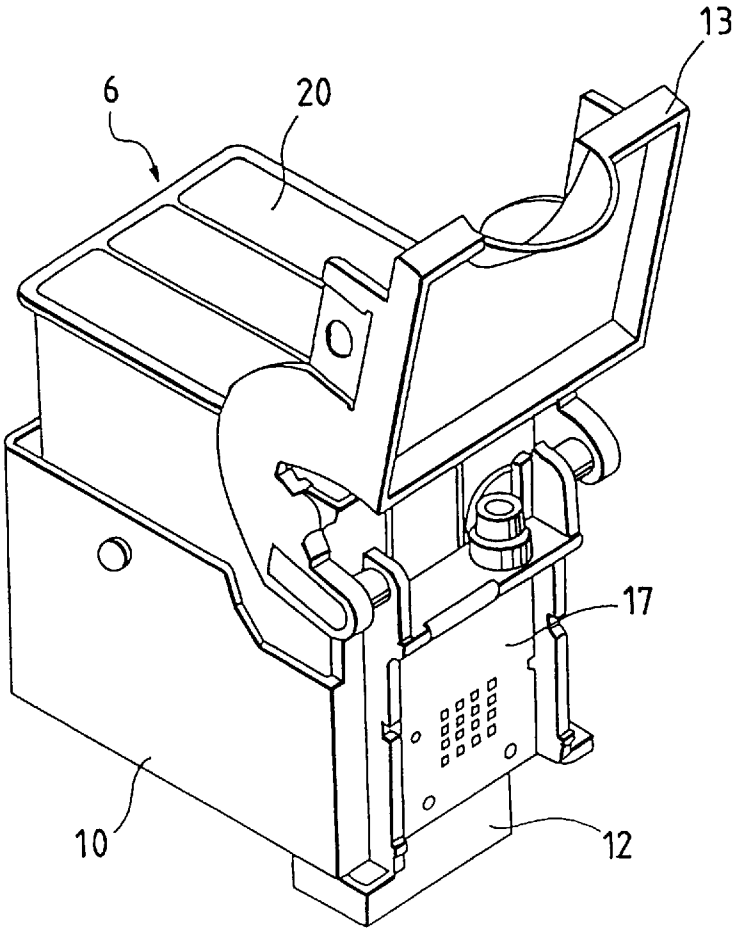
FIG. 2 is a perspective view showing an embodiment of the print unit.

FIG. 2 shows an embodiment of the ink jet print unit 6. In FIG. 2, reference numeral 10 denotes a frame that constitutes a print unit main body. The frame 10 is generally constructed as a container that forms an ink cartridge accommodating chamber 11 (see FIG. 3) for accommodating an ink cartridge 20 therein. An ink jet recording head 12 is arranged on the bottom of the frame 10, the bottom confronting the carriage 1. Further, an ink cartridge fixing lever 13 is arranged in the upper opening of the frame 10. The ink cartridge fixing lever 13 not only fixes the ink cartridge 20 but also pulls up the ink cartridge 20 out of the accommodating chamber 11.

Figure 3:
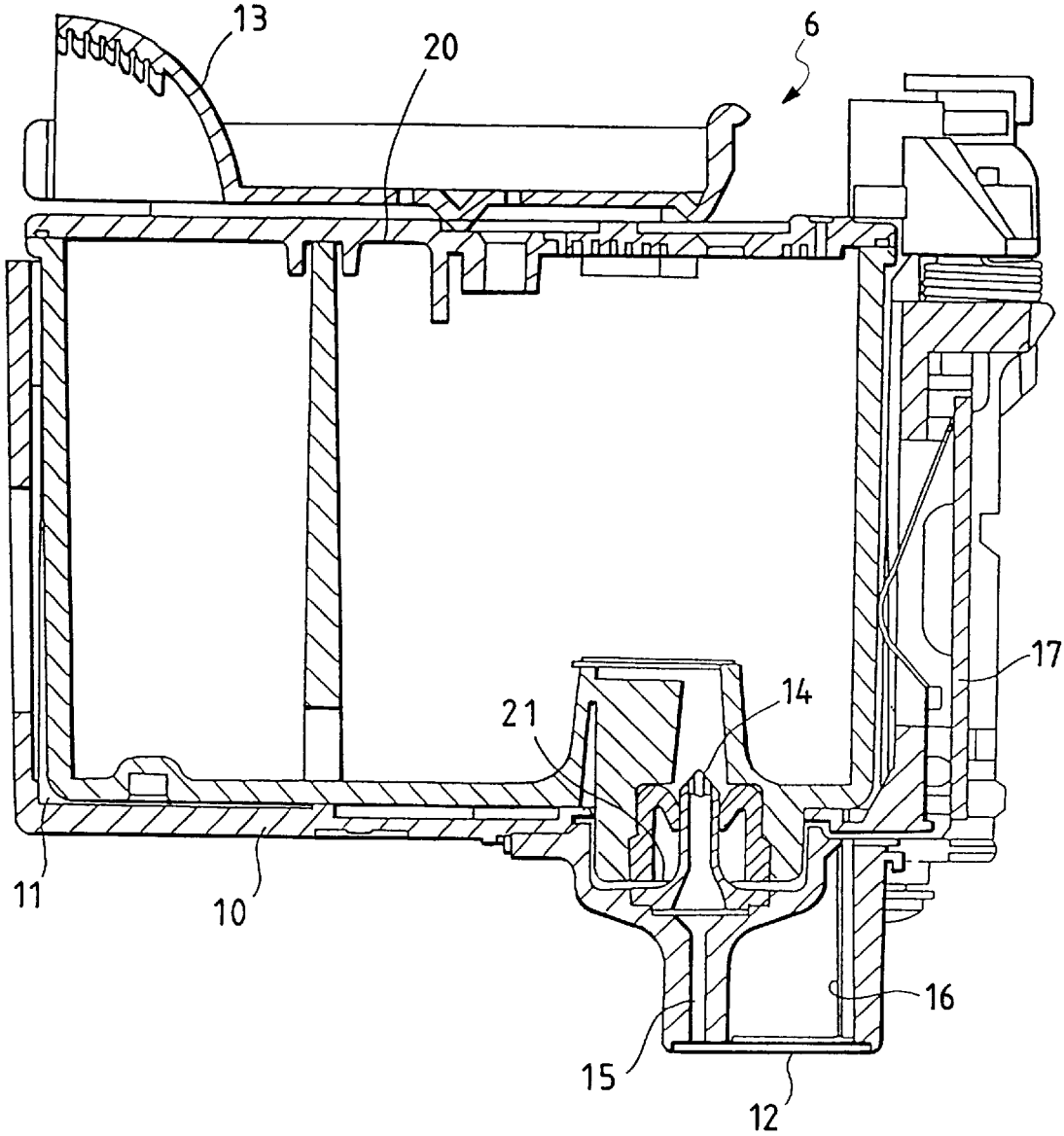
FIG. 3 is a sectional view showing a structure of the print unit with an ink cartridge contained therein.

FIG. 3 shows the ink jet print unit 6 with the ink cartridge 20 accommodated therein. An ink supply needle 14 erects from the bottom of the frame 10. When the ink cartridge 20 is set in the ink cartridge accommodating chamber 11, the ink supply needle 14 becomes fitted with an ink supply port 21 so as to be impermeable to liquid so that an ink can be supplied to the recording head 12 from the ink cartridge 20 through an ink supply passage 15.

The recording head 12 is connected to a terminal board 17 through a flexible cable 16 so that a drive signal from the drive circuit is received through a connecting terminal arranged on the carriage 1.

Figure 4:
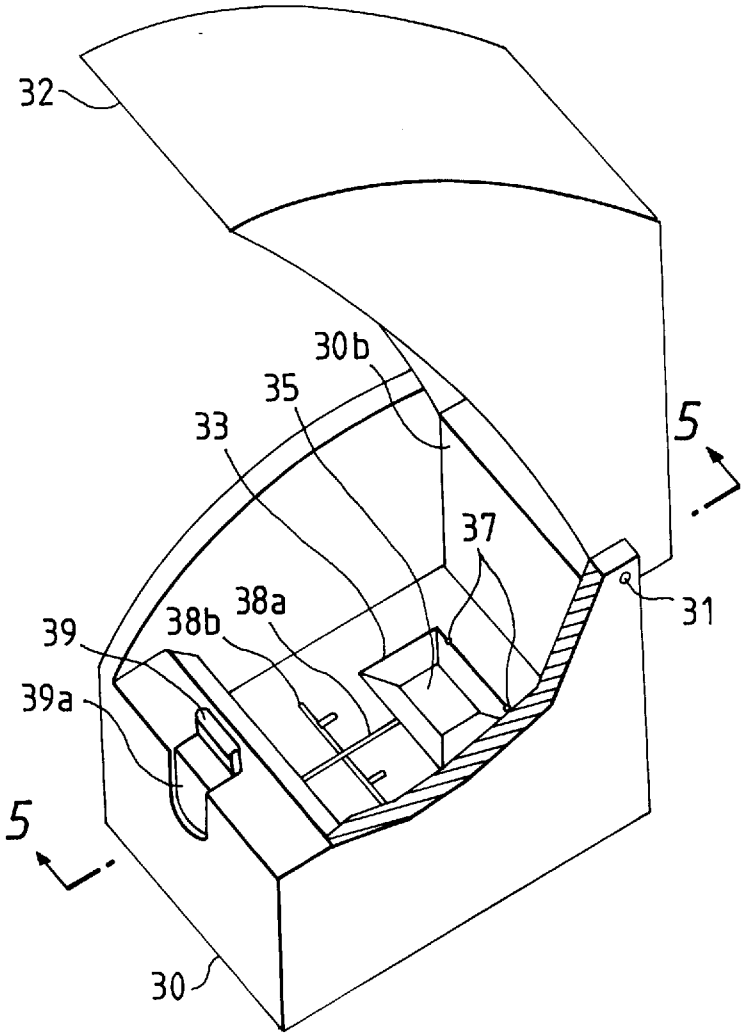
FIG. 4 is a perspective view showing a storing case, which is a first embodiment of the invention.
Figure 5:
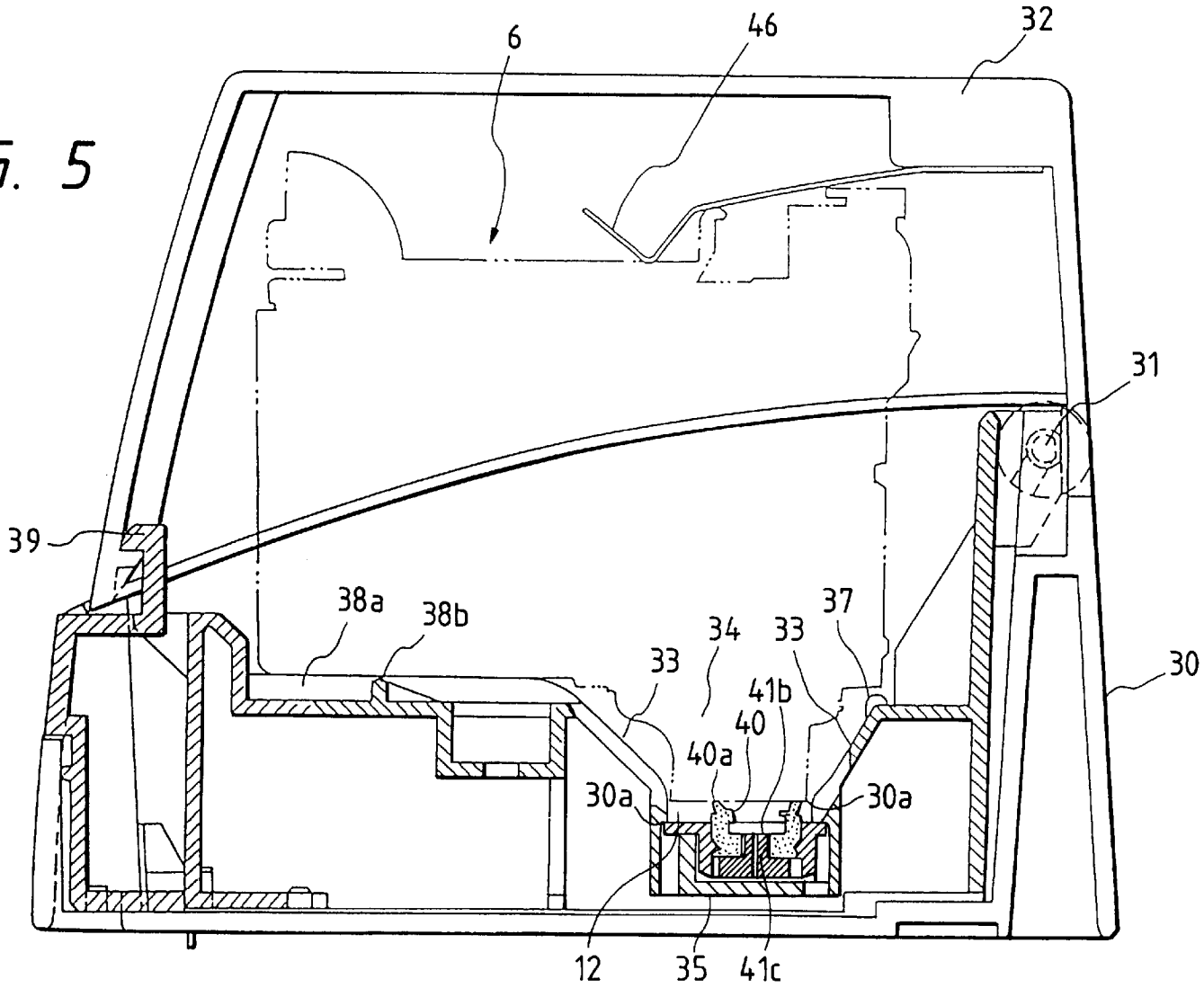
FIG. 5 is a sectional view of the storing case of FIG. 4 taken along the lines 5—5.

FIGS. 4 and 5 show a first embodiment of a case that stores the aforementioned print unit 6. In FIGS. 4 and 5, reference numeral 30 denotes a case main body in which the print unit 6 is placed. A cover member 32 is attached to the upper end of one side of the case so as to be turnable by a shaft 31.

The case main body 30 includes an upwardly expanding recess 34 having guide surfaces 33, 33 . . . . The recess 34 guides the recording head 12 at the time of inserting the print unit 6 into the case main body 30. A capping means 35, which will be described later, is formed on the bottom of the recess 34.

Figure 6:
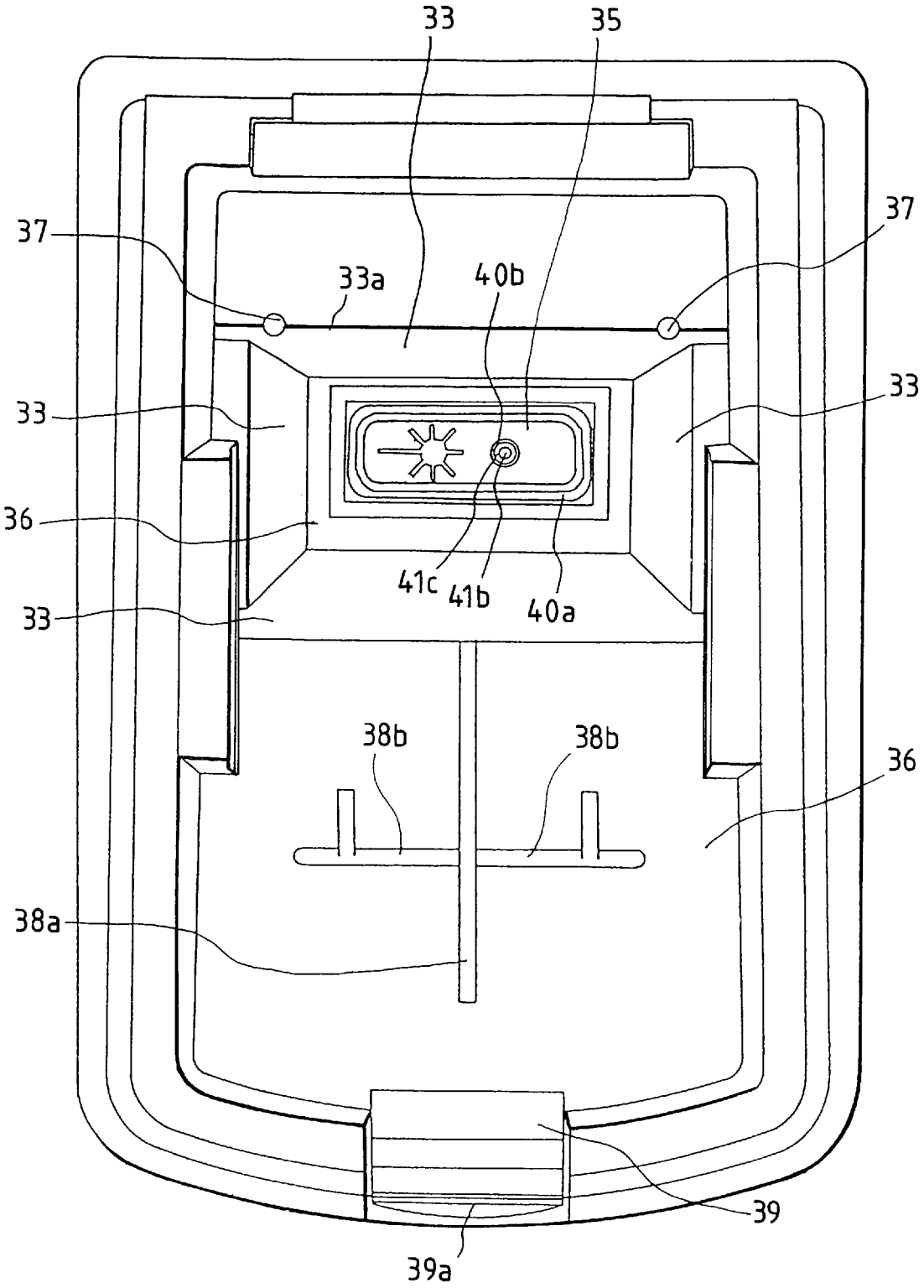
FIG. 6 is a diagram showing a structure of an upper surface of the storing case of FIG. 5.

On an upper surface 36 (see FIG. 6) of the case main body 30 are two projections 37, 37 and a first ridgelike body 38*a* and a second ridgelike body 38*b*, the upper surface 36 confronting the bottom of the main body of the print unit 6. As shown in FIG. 6, these projections and ridgelike bodies are formed so as to interpose the recess 34 therebetween. The two projections 37, 37 are arranged in the rear of the print unit 6 (on the upper side as viewed in FIG. 6) at an interval slightly smaller than the width of the print unit 6 so as to be aligned with a ridgeline 33*a* on top of one of the guide surfaces 33, 33 . . . . The first ridgelike body 38*a* and the second ridgelike body 38*b* are arranged in the front of the print unit 6 (on the lower side as viewed in FIG. 6) on symmetrical lines so as to come in direct contact with the print unit 6. The second ridgelike body 38*b* is shorter in height than the first ridgelike body 38*a*.

The print unit 6 is supported at three points by the projections 37, 37 and the ridgelike body 38*a* so that a nozzle plate surface of the recording head 12 can be positioned so as to come in contact with the capping means 35 (to be described later) in parallel therewith. It may be noted that the second ridgelike body 38*b* is provided to prevent the print unit 6 from excessively inclining.

A lock member 39 is provided in the front of the case main body 30. The lock member 39 engages with the cover member 32 to keep the cover member 32 closed and disengages from the cover member 32 through the pressing of a protuberance 39*a*.

On the other hand, a cantilevered plate spring 46 is arranged on the cover member 32. The plate spring 46 has one end thereof fixed and the other end thereof brought into resilient contact with the upper surface of the print unit 6 upon closing of the cover member 32.

The aforementioned capping means 35 will be described with reference to FIGS. 5 and 6.

In FIGS. 5 and 6, reference numeral 40 denotes a cap made of a resilient material such as rubber. The cap 40 has an upper edge portion 40*a* that comes in resilient contact with the periphery of the nozzle opening surface so as to form a space between the nozzle opening surface and a top surface of the cap 40. The shape of the cap 40 is cuplike so as to keep the nozzle openings of the nozzle plate airtight. An insertion hole 40*b* is formed in the bottom of the cap 40 so that a projection 41*c* having a through hole 41*b* of a cap holder 41, which is shown in FIG. 7(*b*) and will be described later, is exposed to the space.

Reference numeral 41 denotes the cap holder, which is formed into a frame body that supports the periphery of the cap 40 excluding the upper edge portion 40*a* of the cap 40. The cap holder 41 is accommodated in and fixed to the recess 34 with an upper end 41*a* (see FIGS. 7(*a*) and 7(*b*)) thereof retained by catches 30*a* formed on the case main body.

Figure 7A:
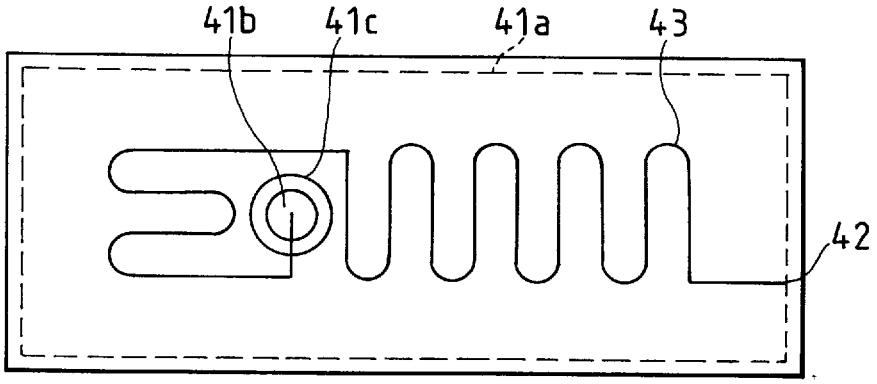
FIGS. 7(*a*) and 7(*b*) respectively show capillary forming grooves formed in a capping means and a seal structure thereof.
Figure 7B:
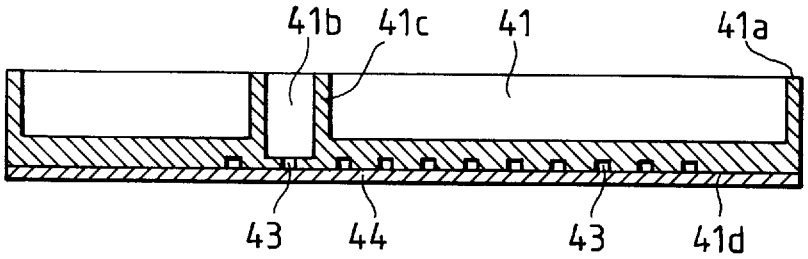

As shown in FIG. 7(*b*), a meandering groove 43 is arranged on a back surface 41*d* of the cap holder 41. One end of the groove 43 communicates with the through hole 41*b* and the other end thereof communicates with an air vent 42 that is open to the atmosphere. The opening of the groove 43 is sealed by a film 44 as shown in FIG. 7 (*b*) so that a capillary serving as a fluid resisting passage can be formed. It may be noted that reference numeral 41*b* denotes the through hole that connects the insertion hole 40*b* to the groove 43.

In this embodiment, when the print unit 6 is inserted into the case main body 30 with the recording head 12 aligned with the recess 34 after the cover member 32 has been opened, the recording head 12 is lowered while guided by the sloped guide surfaces 33, 33 . . . , so that the recording head 12 is supported at the three points, namely, by the projections 37, 37 in the rear and by the ridgelike body 38*a* in the front. As a result, the nozzle plate is positioned in parallel with the cap 40 to thereby allow the upper edge portion 40*a* of the cap 40 to be in resilient contact with the nozzle plate.

Even if the nozzle plate of the recording head 12 may come in contact with the ridgelike bodies 38*a*, 38*b* during this inserting operation, these ridgelike bodies 38*a*, 38*b* can support the nozzle plate with comparatively large surfaces. Therefore, the nozzle plate will not be damaged. It may be noted that the projections 37, 37 formed in the rear in no way confront the nozzle plate because the projections 37, 37 are close to a wall surface 30*b* (see FIG. 4) of the case main body 30 and because the print unit 6 comes in contact with the wall surface 30*b*.

When the cover member 32 is closed under this condition, the lock member 39 of the case main body 30 is engaged with the cover member 32. As a result, the print unit 6 has the upper surface thereof resiliently urged downward by the plate spring 46, which in turn allows the upper edge portion 40*a* of the cap 40 to come in resilient contact with the nozzle plate so as to enclose the nozzle openings. Hence, the nozzle openings are sealed by the cap 40.

A solvent in the ink evaporated from the nozzle openings is introduced into the meandering groove 43 from the through hole 41*b* and stagnates in this groove 43 to keep the solvent under high partial pressure within the cap 40. As a result, the evaporating of the ink from the recording head 12 can be suppressed as much as possible.

On the other hand, when temperature and atmospheric pressure fluctuate, the cap 40 draws air through the air vent 42 and the meandering groove 43, and this brings the pressure within the cap 40 into equilibrium with the pressure within the ink cartridge 20. As a result, the elevation and depression of the meniscus formed in each nozzle opening can be prevented.

To remove the print unit 6 that is in storage, one biases the protuberance 39*a* to disengage the cover member 32 from the lock member 39. As a result, the cover member 32 is automatically turned upward by the resiliency of the plate spring 46 to be opened.

Figure 8:
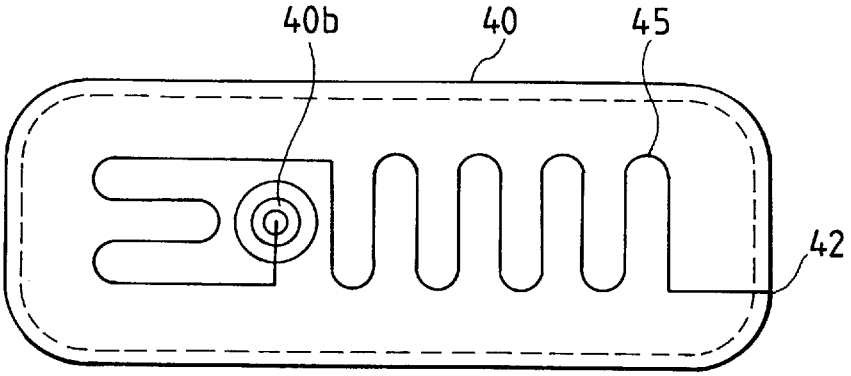
FIG. 8 is a diagram showing another embodiment of a capillary.

The capillary is arranged by forming the groove 43 on the back surface of the cap holder 41 and sealing the groove 43 by the film 44 in the aforementioned embodiment. The capillary also may be arranged, as shown in FIG. 8, by forming a groove 45 on one surface at which the cap 40 comes in contact with the cap holder 41, e.g., on the back surface of the cap 40, and sealing the groove 45 by a surface of another member, e.g., by the upper surface of the cap holder 41 in this embodiment; or a capillary tube itself may be connected in such a manner that one end thereof communicates with the cap 40. Advantages similar to those presented above can be obtained by these alternate constructions.

Figure 9:
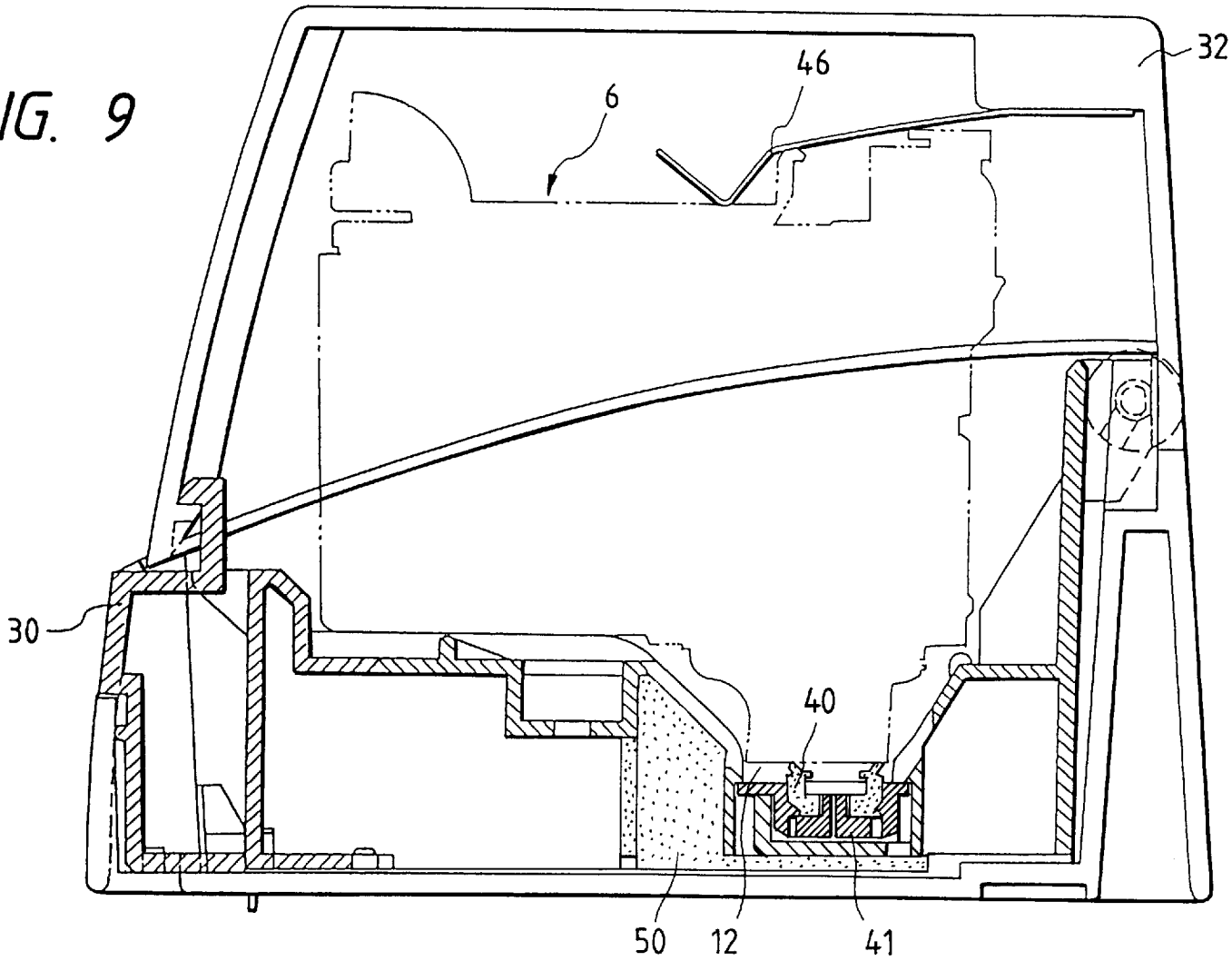
FIG. 9 is a sectional view showing a second embodiment of the invention.

FIG. 9 shows a second embodiment of the invention. In FIG. 9, reference numeral 50 denotes an ink adsorbing member made of a porous material such as felt. The ink absorbing member 50 is loaded around the lower periphery of the cap holder 41.

According to the second embodiment, the ink leaking from the recording head 12 is introduced into the groove 43 from the through hole 41*b* toward the air vent 42, but is absorbed by the ink absorbing member 50 present below the cap holder 41. As a result, the leaking of the ink out of the storing case can be prevented.

Figure 10:
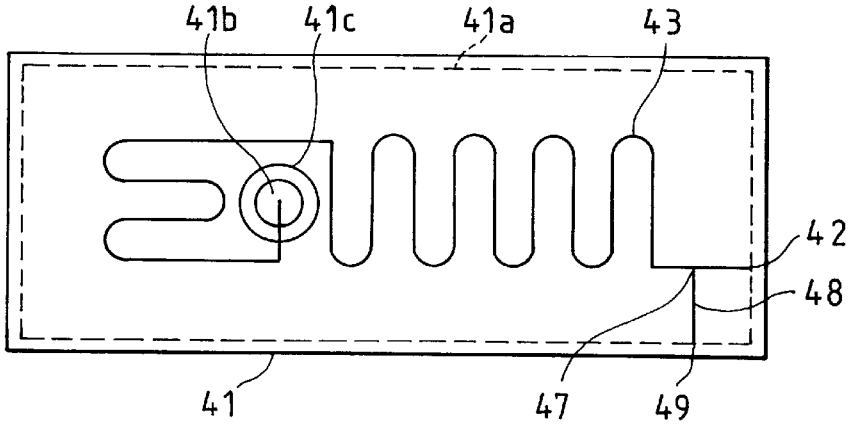
FIG. 10 is a diagram showing another embodiment of the capillary.

FIG. 10 shows an embodiment of the capillary suitable in the case where the ink absorbing member is used as described above. This embodiment is characterized as arranging a branch 47 in the vicinity of the air vent 42 to thereby form a second groove 48 reaching the ink absorbing member 50. An end of the second groove 48 is brought into contact with the ink absorbing member 50.

In this embodiment, when the ink leaking from the recording head 12 flows into the cap 40, the ink moves up to the branch 47 via the groove 43 and is absorbed by the ink absorbing member 50 communicating with the second groove 48.

When all the ink within the grooves 43, 48 has been absorbed, the capillary force of the fluid is lost because the branch 47 communicates with the air vent 42, which in turn prevents the ink from being uselessly absorbed from the recording head 12.

Figure 11:
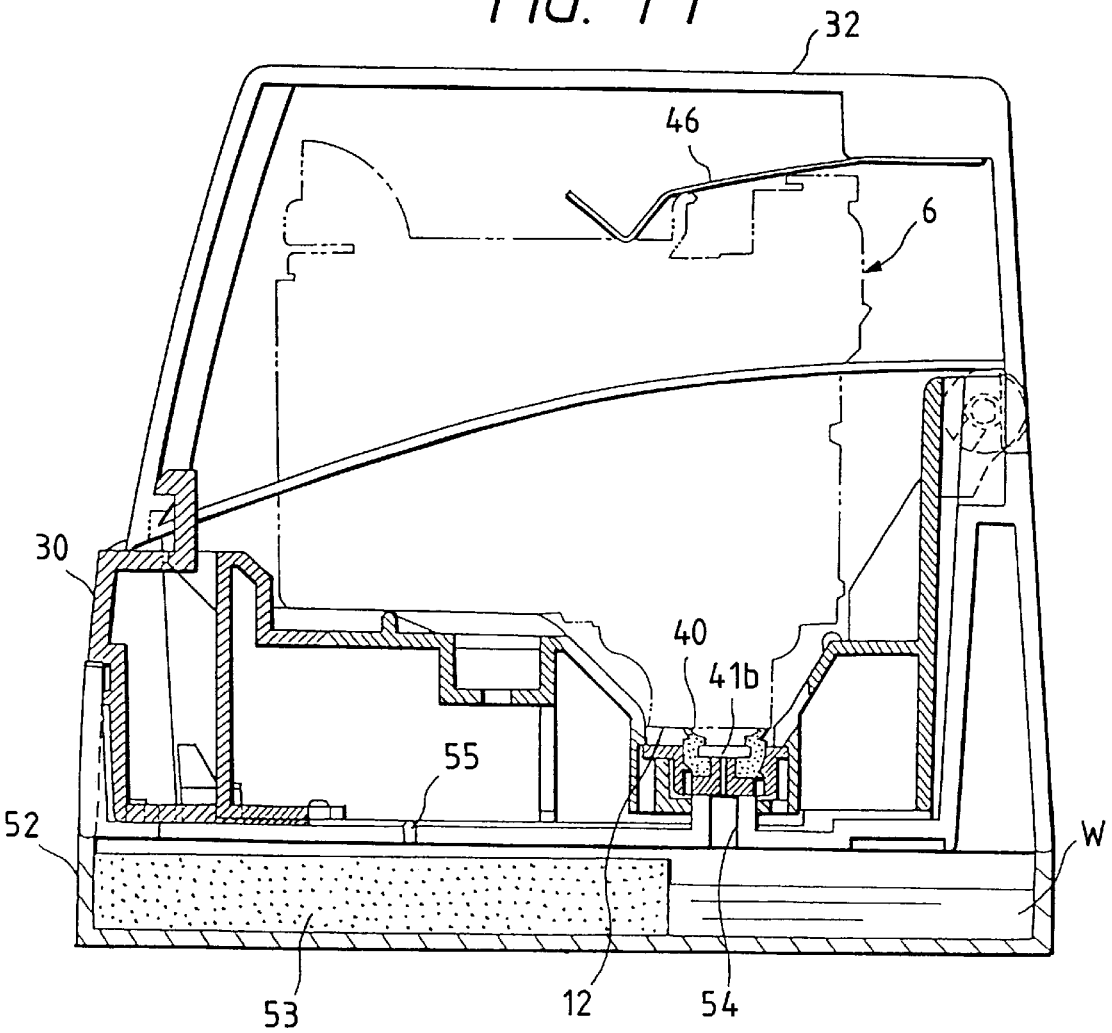
FIG. 11 is a sectional view showing a third embodiment of the invention.

FIG. 11 shows a third embodiment of the invention. In FIG. 11, reference numeral 52 denotes a tank for storing a fluid, e.g., water w, that suppresses the evaporating of the solvent in the ink. The tank 52 has a porous material 53 such as felt loaded therein as necessary, and is caused to communicate with the cap 40 through a passage 54 such as a tube. It may be noted that reference numeral 55 denotes a communication hole formed in the tank 52.

According to this embodiment, the partial pressure of a gas equivalent to the solvent in the ink within the cap 40 is maintained at as high a level as possible by the gasification of the liquid within the tank 52. Therefore, the evaporating of the ink within the tank can be suppressed.

As described in the foregoing, the invention is characterized as having a case main body with a cap and a cover member with a resilient member. That is, the case main body has the cap at a position confronting the recording head when the print unit is accommodated in the case main body. The cap not only is such that the peripheral edge thereof comes in resilient contact with the recording head so as to form a space with respect to the nozzle openings of the recording head, but also communicates with the atmosphere through the fluid resisting passage. The cover member is arranged on the case main body so as to be opened and closed, and has the resilient member that resiliently urges the print unit toward the cap. As a result of this construction, the invention can keep the meniscus of each nozzle opening of the recording head ready for printing independently of temperature and pressure fluctuations while preventing the evaporating of the ink from the nozzle openings as much as possible.

What is claimed is:

1. A case for storing an ink jet print unit, the ink jet print unit holds integrally a recording head having nozzle openings for jetting ink droplets and an ink tank for supplying an ink to the recording head, the case comprising a case main body with a cap disposed therein and a cover member with a resilient member for urging said print unit into said case, the cap has an upper peripheral edge which comes in resilient contact with the recording head so as to form a space with respect to the nozzle openings at a position confronting the recording head when the print unit is accommodated in the case main body, the cap is in communication with the atmosphere through a fluid resisting passage for suppressing an evaporation of the ink from the recording head and for preventing an elevation and a depression of meniscuses formed in respective nozzle openings of the recording head, the cover member being arranged on the case main body so as to be operable and closable and the resilient member resiliently urges the print unit toward the cap.

2. A storing case according to claim 1, wherein the cap is arranged in the case main body, wherein the cap is supported by a cap holder so as to expose the upper peripheral edge of the cap.

3. A storing case according to claim 1, wherein the fluid resisting passage is constructed of a meandering groove on at least one of a surface of the cap, which confronts the cap holder, a confronting surface of the cap holder, and on a back surface of the holder.

4. A storing case according to claim 1, wherein the fluid resisting passage is constructed of a capillary tube.

5. A storing case according to claim 1, wherein an ink absorbing member is arranged in a lower peripheral edge of the cap holder.

6. A storing case according to claim 5, wherein the fluid resisting passage is branched into a passage communicating with the atmosphere and a passage communicating with the ink absorbing member.

7. A storing case according to claim 1, wherein the case main body further includes an upwardly expanding recess having inclined guide surfaces for guiding the recording head into the case main body.

8. A storing case according to claim 1, further including two projections and a first and second ridgelike body formed on an area confronting a bottom surface of the print unit, the two projections being pitched at a predetermined interval so as to interpose the cap therebetween, and the ridgelike bodies being positioned substantially perpendicular to one another, wherein the two projections and the ridgelike bodies are for supporting the print unit.

9. A storing case according to claim 8, wherein a height of the first ridgelike body is larger than a height of the second ridgelike body.

10. A storing case according to claim 1, further comprising a fluid-storing tank in communication with said cap, wherein a porous material is disposed in said fluid-storing tank.

11. A case for storing an ink jet print unit, the ink jet print unit having a recording head and an ink tank held integrally, the recording head having nozzle openings for jetting ink droplets, the ink tank supplies an ink to the recording head, the case comprising a case main body with a cap disposed therein and a cover member with a resilient member for urging said print unit into said case, the cap has an upper peripheral edge which comes in resilient contact with the recording head so as to form a space with respect to the nozzle openings at a position confronting the recording head when the print unit is accommodated in the case main body, the cap is in communication with a fluid storing means, the cover member being arranged on the case main body so as to be operable and closable, and the resilient member resiliently urges the print unit toward the cap, and wherein said fluid storing means contains a fluid other than ink leaking out from the ink jet print unit stored in said case.

12. A storing case according to claim 8, further including two projections and a first and second ridgelike body formed on an area confronting a bottom surface of the print unit, the two projections being pitched at a predetermined interval so as to interpose the cap therebetween, and the ridgelike bodies being positioned substantially perpendicular to one another, wherein the two projecting and the ridgelike bodies are for supporting the print unit.

13. A storing case according to claim 12 wherein a height of the first ridgelike body is larger than a height of the second ridgelike body.

14. A storing case according to claim 10, wherein said fluid-storing tank in communication with said cap contains a fluid other than ink leaking out from the ink jet print unit stored in said storing case.

* * * * *